US007445376B2

(12) United States Patent
Hiranuma et al.

(10) Patent No.: US 7,445,376 B2
(45) Date of Patent: Nov. 4, 2008

(54) TIMEPIECE HAVING GLASS AND GLASS-HOLDING MEMBER REMOVABLE AS A UNIT FROM CASE BAND

(75) Inventors: Haruki Hiranuma, Chiba (JP); Nobukazu Omori, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/635,471

(22) Filed: Dec. 7, 2006

(65) Prior Publication Data

US 2007/0147184 A1 Jun. 28, 2007

(30) Foreign Application Priority Data

Dec. 26, 2005 (JP) ..... 2005-372820

(51) Int. Cl.
*G04B 37/08* (2006.01)

(52) U.S. Cl. ..... 368/294; 368/310

(58) Field of Classification Search ..... 368/294–296, 368/291, 286, 309–310; 968/368, 373
See application file for complete search history.

(56) References Cited

U.S. PATENT DOCUMENTS 2,327,112 A * 8/1943 Kramer et al. ..... 368/291
3,979,902 A * 9/1976 Miyasaka et al. ..... 368/294
4,496,248 A * 1/1985 Waki et al. ..... 368/291

* cited by examiner

*Primary Examiner*—Renee Luebke
(74) *Attorney, Agent, or Firm*—Adams & Wilks

(57) ABSTRACT

A timepiece has a case band having a front side end part that projects inwardly toward the hollow interior of the case band and terminates in a front opening. A case back is detachably attached to a back side end part of the case band. A glass is fixed to an annular edge member that seats on a front face of the front side end part. The edge member has a tubular part slidably inserted into the front opening and threadedly engaged with an annular attaching member in the interior of the case whereby the front side end part of the case band is sandwiched and held between the edge member and attaching member. By detaching the case back and using a tool to unthread the attaching member from the edge member, the edge member and glass can be removed as a unit from the case band for repair or replacement.

14 Claims, 4 Drawing Sheets

FIG. 2
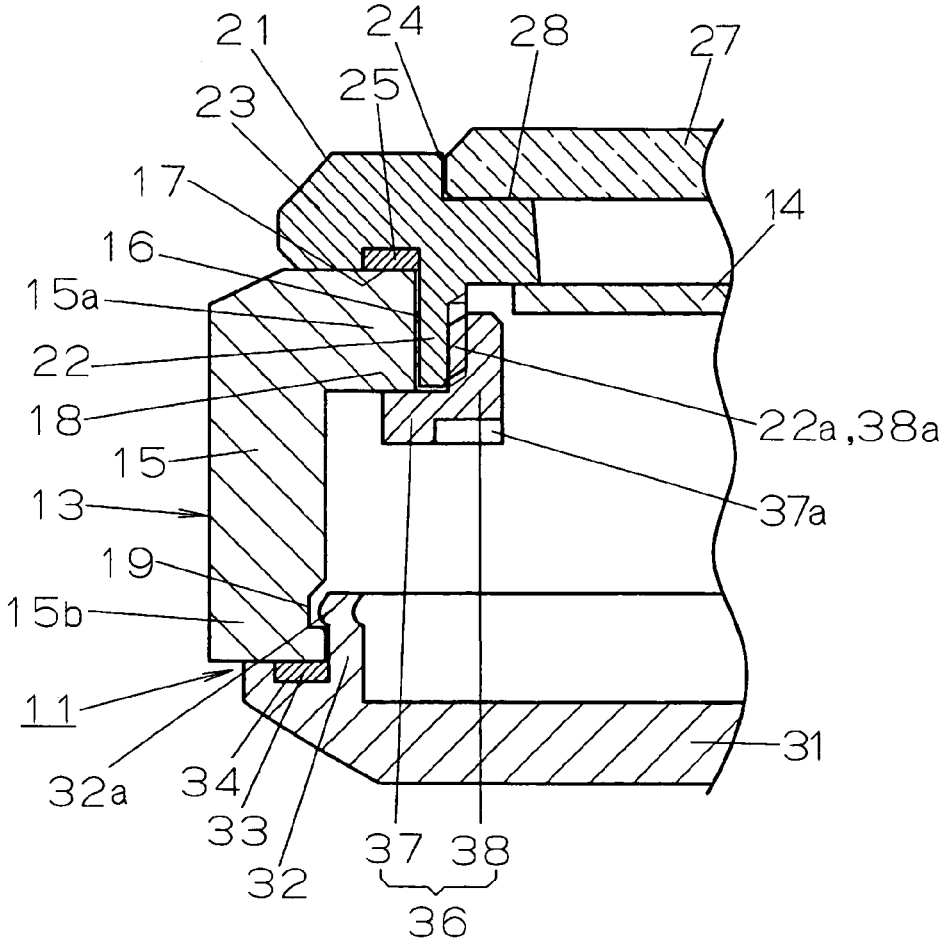
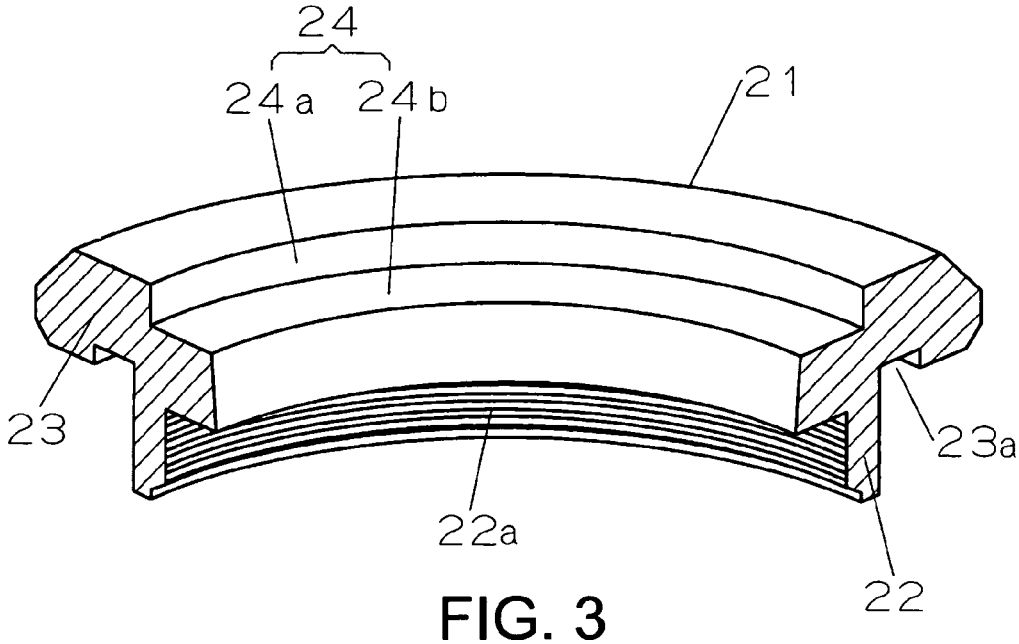
FIG. 3

FIG. 4A
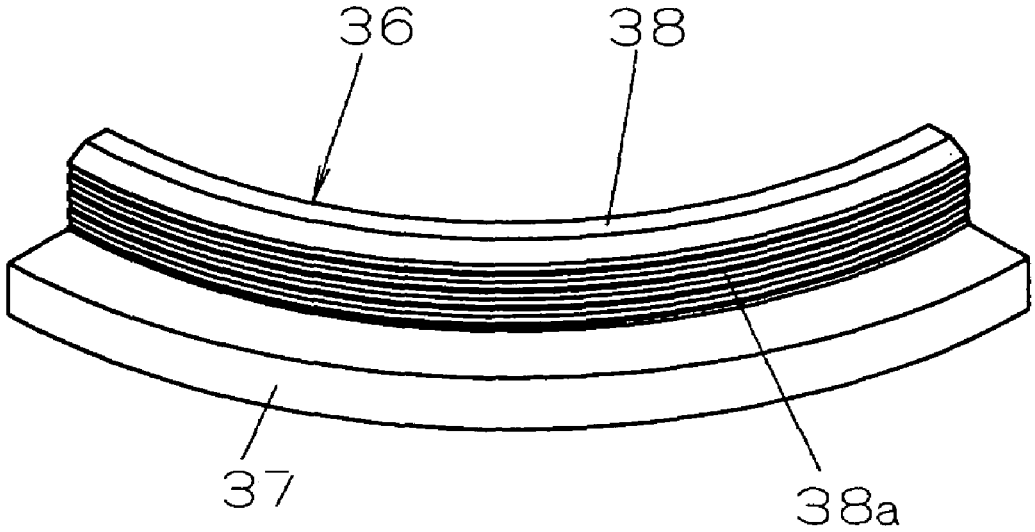
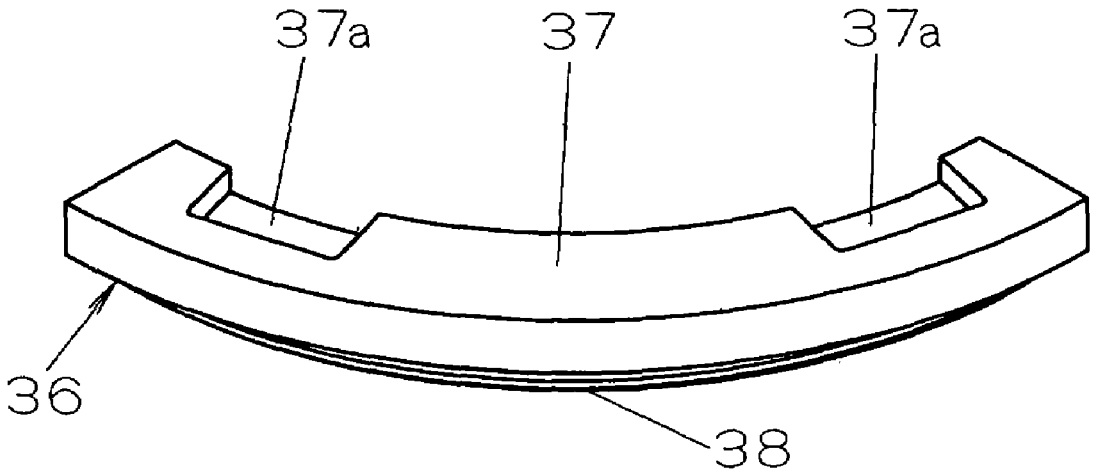
FIG. 4B

TIMEPIECE HAVING GLASS AND GLASS-HOLDING MEMBER REMOVABLE AS A UNIT FROM CASE BAND

BACKGROUND OF THE INVENTION

1. Field of the Invention

The present invention relates to a timepiece such as a portable watch like, e.g., a wristwatch and a pocket watch, a desk clock and a wall-mounted clock.

2. Description of the Prior Art

Hitherto, among wristwatches possessing a case back, there is known a wristwatch in which an annular protrusion part is formed in an inner periphery of a front side end part of a case band in which a dial is accommodated, to the inner periphery of this annular protrusion part, a glass covering the dial is fitted and fixed and a tubular part of an edge member functioning also as a bezel is fitted, and a caulking part integral with this tubular part is caulked to a back face of the annular protrusion part (for example, refer to JP-UM-B-5-37273 Gazette).

In the wristwatch in which the edge member has been caulked to the case band as mentioned above, since the fact that a caulked part having been deformed is caulked again after having been returned to a state before being caulked extremely decreases a mechanical strength of the caulked part, it is impossible to detach the edge member from the case band. For this reason, in a case where the edge member has been impaired, a user of the wristwatch is obliged to exchange not only the edge member to which the glass has been fixed but also the case band to which this edge member has been caulked.

Further, in a wristwatch in which a waterproofness has been intended by nipping a seal packing between the case band and the edge member, there is considered the fact that a performance of the seal packing decreases during a long period guarantee term of the wristwatch and thereafter. Also in a case where, in order to cope with this, it is attempted to exchange the seal packing, since it is possible to detach the edge member from the case band, it is obliged to exchange not only the edge member but also the case band to which this edge member has been caulked.

SUMMARY OF THE INVENTION

An object of the present invention is to provide a timepiece in which it has been made possible to exchange the edge member to which the glass has been fixed, without also exchanging the case band.

The present invention comprises an annular case band which has a front side end part forming a fitting hole, and in which the end part has an edge receiving face around the fitting hole, and a case back detachably attached to a back side end part of the case band. An annular edge member has a tubular part capable of being inserted into and disengaged from the fitting hole and a cover part that overlaps the edge receiving face. A glass is fitted and fixed to an annular step part formed in the edge member, and an attaching member detachably attaches the tubular part to the front side end part, and is attached/detached under a state that the case back has been detached.

In the present invention, the edge receiving face may be provided continuously so as to bulge from a front side open end of the fitting hole to its periphery, or may be provided by forming a step between it and the front side open end such that the front side open end and the edge receiving face exist in different height positions about a thickness direction of the case band. Further, the edge receiving face and a contact face, of the cover part, contacting with the former is not limited to a plane along a direction perpendicularly intersecting with a thickness direction of the case band, and may be a slant face along a direction slantingly intersecting with the thickness direction of the case band or a curved face curving along the direction slantingly intersecting with the thickness direction of the case band.

In the present invention, the outer periphery of the tubular part and the fitting hole into which this tubular part is inserted may be a circular shape or a polygonal shape. In the present invention, a fixation of the glass to the annular step part of the edge member may be fixed by using an adhesive, or pressure-inserting the glass to the annular step part with a seal part having an elasticity being nipped between it and the annular step part.

In the present invention, the attaching member is not limited to a thread ring which will be explained in an embodiment. For example, it is also possible to use an attaching member consisting of a snap ring of a C-shaped form or the like, which is detachably attached to an annular groove having been formed in an outer periphery face of the tubular part having been formed longer than a thickness of the front side end part of the case band, and which is caught to an engaging back face of the front side end part under a state attached to this groove, thereby nipping this front side end part between it and the cover part. Or, in a case where in the front side end part of the case band there has been formed an annular locking groove opening to an inner periphery face of the case band, and in the tubular part there have been formed an annular attaching groove opening to an inner periphery of the tubular part and plural through-holes which communicate with the annular attaching groove and communicate with the annular locking groove under a state that the tubular part has been inserted into the fitting hole, it is also possible to use a C-shaped attaching member having an elasticity, which has plural catching parts inserted into the annular locking groove through the through-hole to thereby be caught and is attachable/detachable to/from the annular attaching groove. In this case, a surface side end part of the case band may protrude into an inner hollow part of the case band, or may not protrude.

In the present invention, a state that the cover part of the edge member has been overlapped with the edge receiving face of the case band by the fact that the tubular part of the edge member to which the glass has been fixed is inserted into the fitting hole of the case band, is held by the attaching member having been accommodated inside the case band and attached to the tubular part, and this attaching member can be attached/detached under a state that the case back has been opened. For this reason, in a case where the edge member has been impaired or the like, the edge member can be attached to and detached from the case band by attaching/detaching the attaching member. Accordingly, the edge member to which the glass has been fixed can be exchanged without accompanying the case band.

In a preferred mode of the present invention, there is possessed an annular seal packing having been nipped between the edge receiving face and the cover part under a compressed state. Here, the seal packing may be provided by annularly forming a holding groove in either of the edge receiving face and the cover part and fitting it to this holding groove, or also can be provided without forming such a holding groove.

In this preferred mode, as already mentioned, since incorporation and separation of the edge member with respect to the case band can be performed by the attachment/detachment of the attaching member, in a case where a performance of the seal packing bearing a waterproofness/dustproofness between the edge receiving face and the cover part has decreased, it is possible to exchange this packing without accompanying at least the case band between the case band and the edge member.

Additionally, in a preferred mode of the present invention, the front side end part has an engaging back face continuous so as to bulge around the fitting hole, the tubular part has a female thread part, and the attaching member has a male thread part meshed with the female thread part and a ring base part which is caught to the engaging back face to thereby nip the front side end part between it and the cover part.

In this preferred mode, rotation operation of the attaching member enables fixation of the edge member to the case band by a screwing of the edge member with respect to the tubular part, and separation of the edge member from the case band by a release of the screwing with respect to the tubular part. For this reason, attachment/detachment operation of the edge member with respect to the case band in a narrow space in the case band can be simply performed without requiring a labor for deforming the attaching member.

Further, in a preferred mode of the present invention, there is possessed a rotation-stop, means which whirl-stops the edge member by engaging the fitting hole and the tubular part in their peripheral direction. Here, as the rotation-stop means, there can be enumerated, e.g., a means in which outer peripheries of the fitting hole and the tubular part are made a polygonal shape, and which whirl-stops the edge member by a catching in a peripheral direction by butting (engaging) between a corner of the polygonal fitting hole and a corner of the tubular part. Other than this, there can be enumerated a means which whirl-stops the edge member by a catching in the peripheral direction by an engagement between one or more groove(s) having been provided in one of the fitting hole and the tubular part and one or more convex part(s) having been provided in the other, or the like.

In this preferred mode, when the attaching member is meshed and screwed to the tubular part of the edge member, since the rotation-stop means whirl-stops the edge member, the screwing of the attaching member becomes easy and the edge member can be certainly fixed. Moreover, since the edge member is positioned with respect to the case band by the whirl-stop, in a case where the edge member is an ornament ring like a bezel, it is desirable also in a point that the case band can be fixed to the edge member with an ornament site of this ring being held in a suitable position.

Further, in a preferred mode of the present invention, the glass is fixed to the annular step part by an adhesive.

In this preferred mode, since the attachment/detachment of the edge member to/from the tubular part of the edge member is performed without giving an excessive strain to the edge member, there is no fear that the glass is exfoliated with the strain of the edge member which is caused when the edge member to/from the case band is attached/detached. Moreover, in addition to the fact that a periphery face of the glass is bonded to an annular periphery face of the annular step part along a thickness direction of the edge member, since a periphery part back face of the glass is bonded to a seat face of the annular step part continuous perpendicularly to the annular periphery face, a bonding area can be largely ensured. For this reason, it is possible to thin a thickness of the edge member while ensuring a necessary bonding area with respect to the glass.

BRIEF DESCRIPTION OF THE DRAWINGS

A preferred form of the present invention is illustrated in the accompanying drawings in which:

FIG. 2 is a sectional view showing one part of the wristwatch of FIG. 1, while being enlarged;

FIG. 3 is a perspective view showing one part of an edge member of the wristwatch of FIG. 1;

FIG. 4A is a perspective view showing one part of an attaching member that the wristwatch of FIG. 1 possesses, while being seen from a front side; FIG. 4B is a perspective view showing one part of the attaching member that the wristwatch of FIG. 1 possesses, while being seen from a back side.

DETAILED DESCRIPTION OF THE INVENTION

A first embodiment of the present invention is explained by referring to FIG. 1 through FIG. 4.

Figure 1:
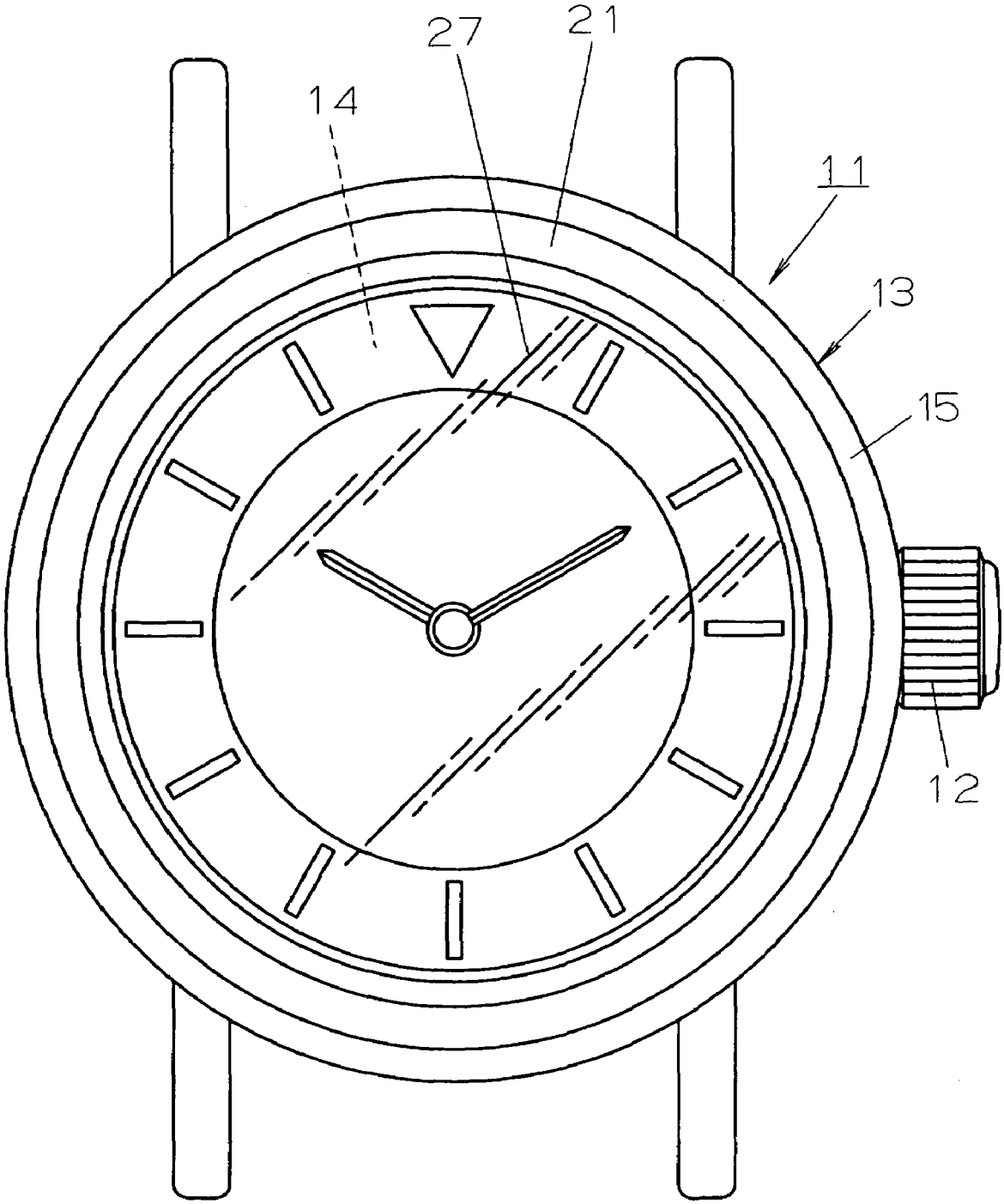
FIG. 1 is a plan view showing a wristwatch according to a first embodiment of the present invention.

In FIG. 1, a reference numeral 11 denotes a timepiece, e.g., a portable timepiece capable of screw-locking a crown 12, such as a wristwatch. As shown in FIG. 2, the wristwatch 11 accommodates, in its timepiece armor assembly 13, a dial 14, a timepiece movement (not shown in the drawing), and the like. The timepiece movement may be, for example, one powered by a small battery or a mainspring, or an automatically winding one, or one corresponding to a digital timepiece which digital-displays a time instant and the like on the dial 14 by a quartz oscillation module, or one in which the one corresponding to the digial timepiece and one other than it have been used in combination, or the like.

The timepiece armor assembly 13 is formed by mounting a glass 27 to a front side of an annular case band 15 through an edge member 21, and liquid-tightly mounting a case back 31 consisting of a metal or the like to a back side of the case band 15.

The case band 15 consists of a metal such as stainless steel and titanium or a synthetic resin. The case band 15 has a front side end part 15*a*. The front side end part 15*a* protrudes radially inwardly toward an inner hollow part of the case band 15, and a fitting hole 16 is formed in a front side of the case band 15 and constitutes the front opening of the case band. The fitting hole 16 is circular for instance.

A surface of the front side end part 15*a* forms an edge receiving face 17. This edge receiving face 17 is formed by a plane continuous perpendicularly to the fitting hole 16 so as to extend, e.g., from a front side open end of the fitting hole 16 to its periphery. A back face of the front side end part 15*a* forms an engaging back face 18. This engaging back face 18 is formed by a plane continues perpendicularly to the fitting hole 16 so as to extend from a back side open end of the fitting hole 16 to its periphery for instance. The edge receiving face 17 and the engaging back face 18 are parallel.

A locking groove 19 is formed in an inner face of a back side end part 15*b* of the case band 15. The case back 31 is detachable with respect to the case band 15 from its back side. For this reason, the case back 31 integrally has an in-case-band tubular part 32 which is elastically deformable, and engaging convex parts 32*a* (only one is shown in the drawing) are formed in several places of the tip part of the in-case-band tubular part 32.

Accordingly, by inserting the in-case-band tubular part 32 into a back side opening of the case band 15, each engaging convex part 32*a* is caught by the engaging groove 19 at the same time as the engaging convex part 32*a* climbs or slides over a lower side edge of the engaging groove 19 while accompanying an elastic deformation of the in-case-band tubular part 32, so that it is possible to detachably mount the case back 31 to the case band 15. Under this attached state, it is possible to detach the case back 31 from the case band 15 by inserting a tip part of a tool such as screw driver (not shown in the drawing) into a peripheral part of the case back 31 and the back side end part 15*b* to thereby detach the engaging convex part 32*a* from the engaging groove 19 by wrenching the case back 31. Incidentally, in FIG. 2, a reference numeral 33 denotes an annular packing made of a resinous elastic material. The seal packing 33 is nipped under a compressed state by the case band 15 and the case back 31, bears the waterproofness/dustproofness between them, and is fitted and attached, e.g., to a holding groove 34 provided in the case back 31.

The edge member 21 is one used as, e.g., a glass edge holding the glass 27, and is annularly formed by the metal such as stainless steel and titanium or the synthetic resin. As shown in FIG. 2 and FIG. 3, the edge member 21 has integrally a tubular part 22, a cover part 23 and an annular step part 24.

The tubular part 22 has, e.g., a cylindrical shape and is configured to be inserted into and disengaged from the fitting hole 16, and its height is shorter than a thickness of the front side end part 15*a* of the case band 15. A female thread part 22*a* is formed in an inner periphery face of this tubular part 22.

The cover part 23 overlaps the edge receiving face 17 of the front side end part 15*a*. In a back face of the cover part 23, there is formed an annular holding groove 23*a* (refer to FIG. 3). To this holding groove 23*a*, there is fitted an annular seal packing 25 (refer to FIG. 2) made of resinous elastic material. A thickness of the seal packing 25 under its free state is larger than a depth of the holding groove 23*a*.

As shown in FIG. 3, the annular step part 24 provided in an inner periphery side of the edge member 21 is formed by an annular periphery face 24*a* and a seat face 24*b*. The annular periphery face 24*a* is provided along a thickness direction of the edge member 21, and the seat face 24*b* is formed continuously, perpendicularly to the annular periphery face 24*a*. It is desirable that an area of the seat face 24*b* is larger than an area of the annular periphery face 24*a*. The glass 27 is fitted and fixed to this annular step part 24 through an adhesive 28 (refer to FIG. 2).

The fixation of the glass 27 to the edge member 21 is performed by fitting the glass 27 to the annular step part 24 after the adhesive 28 has been applied to a corner part that the annular periphery face 24*a* and the seat face 24*b* form. By this, the adhesive 28 between the annular step part 24 and a periphery part of the glass 27 is extended along the annular periphery face 24*a* and the seat face 24*b*, the periphery face of the glass 27 contacting with the annular periphery face 24*a* is bonded, and a periphery part back face of the glass 27 contacting with the seat face 24*b* is bonded to the edge member 21.

The edge member 21 to which the glass 27 has been mounted like this is detachably attached to the case band 15 by using a ring-shaped attaching member 36. For the attaching member 36, there is used a thread ring shown in FIG. 2 and FIG. 4. Detailedly, the attaching member 36 consists of a ring base part 37 and a meshing tube part 38 having been integrally formed in the former.

An outer diameter of the ring base part 37 is larger than the fitting hole 16. As shown in FIG. 4B, the ring base part 37 has in its back face plural operating parts 37*a*. These operating parts 37*a* are formed, e.g., by a concave and provided while being spaced along a peripheral direction of the ring base part 37. As shown in FIG. 4A, a male thread part 38*a* is formed in an outer periphery of the meshing tube part 38. This male thread part 38*a* is detachably meshed (threadedly engaged) with the female thread part 22*a* of the edge member 21.

Attachment/detachment of the edge member 21 to/from the case band 15 is implemented inside the case band 15 as follows under a state that the case back 31 has been detached.

There are explained procedures for attaching the edge member 21, to which the glass 27 and the seal packing 25 have been already incorporated, to the case band 15. First, the tubular part 22 of the edge member 21 is fitted to the fitting hole 16 of the case band 15 from the front side of the case band 15. Next, the attaching member 36 is accommodated into the case band 15 from a back face opening of the case band 15, and the attaching member 36 is screwed by meshing the male thread part 38*a* of the meshing tube part 38 with the female thread part 22*a* of the tubular part 22. In this case, the attaching member 36 is rotation-operated by using a tool which is caught to the operating parts 37*a* in at least two places.

In this manner, from a point of time in which the ring base part 37 of the attaching member 36 has contacted with the engaging back face 18 of the front side end part 15*a* of the case band 15, the edge member 21 is pulled backward and displaced in a back side direction of the case band 15. The back-side displacement ends when the cover part 23 of the edge member 21 butts against and seats on the edge receiving face 17 of the case band 15. At the same time as this, the cover part 23 and the ring base part 37 nip the front side end part 15*a* of the case band 15, and the seal packing 25 is nipped under a compressed state between the cover part 23 and the edge receiving face 17, so that the edge member 21 to which the glass 27 has been fixed is liquid-tightly attached to the case band 15. By this attachment, the glass 27 faces the dial 14.

Next, there are explained procedures for detaching the edge member 21 from the case band 15. First, a tool is inserted from the back face opening of the case band 15 under a state that the case back 31 has been detached, and this tool is caught to the operating part 37*a* that the ring base part 37 of the attaching member has. Next, the attaching member 36 is rotation-operated together with the tool in a direction unscrewing this attaching member 36, thereby detaching the attaching member 36 from the tubular part 22 of the edge member 21. By this, since the holding of the edge member 21 with respect to the case band 15 is released, it is possible to detach the edge member 21 by drawing out it from the case band 15.

Since it is possible to attach/detach the edge member 21 to/from the case band 15 as mentioned above, in a case where the edge member 21 and the glass 27 have been impaired, it is possible to exchange the edge member 21 and the glass 27, which are exchange objects, by detaching them from the case band 15 by the already mentioned procedures. Similarly, also in a case where a waterproof/dustproof performance of the seal packing 25 has decreased due to a long period use of the wristwatch 11, after the edge member 21, to which the glass 27 has been fixed, has been detached from the case band 15 by the already mentioned procedures, it is possible to exchange the seal packing 25 which is similarly the exchange object without having to exchange the edge member 21, to which the glass 27 has been fixed, and the case band 15. Accordingly, in each of these cases, since it becomes unnecessary to discard at least the case band 15 together with an exchange component, an exchange expense for a repair client can be reduced.

In the present embodiment in which the attaching member 36 has been made attachable/detachable to/from the tubular part 22 of the edge member 21 by the rotation operation of this attaching member 36 consisting of the thread ring as already mentioned, the edge member 21 can be fixed to the case band 15 by the screwing of the attaching member 36 with respect to the tubular part 22, and the edge member 21 can be detached by releasing the fixation of this edge member 21 to the case band 15 by a release of the screwing of the attaching member 36 with respect to the tubular part 22. For this reason, an attachment/detachment operation of the edge member 21 with respect to the case band 15 can be implemented by such a simple operation that the attaching member 36 is rotated in a narrow space within the case band 15 without requiring a labor for deforming the attaching member 36, and thus a workability is good.

Moreover, the edge member 21 can be firmly mounted to the case band 15 by screwing the attaching member 36, which has been meshed with the edge member 21, to thereby forcibly urge the cover part 23 of the edge member 21 into engagement with the edge receiving face 17, and a prevention/airtight performance can be made certain by forcibly compressing the seal packing 25. Additionally, since the edge member 21 may not be detached by wrenching the edge member 21 from the front side of the case band 15, there is no fear that the edge member 21 and the front side end part 15*a* of the case band 15 are damaged.

The already-mentioned attachment/detachment of the attaching member 36 to/from the tubular part 22 of the edge member 21 is performed without giving an excessive strain to the edge member 21. By this, there is no fear that, when the edge member 21 is attached/detached to/from the case band 15, the strain of the edge member 21 is exerted on a bonding part of the glass 27 and thus the glass 27 is exfoliated. Like this, since an action exfoliating the bonding does not work when attaching/detaching the edge member 21, a thickness of the edge member 21 can be thinned. It is thereby possible to intend to thin the whole of the wristwatch 11. And, even if the edge member 21 is thinned, in addition to the fact that the periphery face of the glass 27 is bonded to the annular periphery face 24*a* of the annular step part 24 along its thickness direction, since a periphery part back face of the glass 27 is bonded to the seat face 24*b* of the annular step part 24 and a bonding area of the glass 27 with respect to the edge member 21 can be largely ensured, it is possible to certainly fix the glass 27 to the edge member 21.

Incidentally, in a case where the glass 27 is attached to the edge member 21 while an annular elastic packing is nipped between the periphery face of the glass 27 and the annular periphery face 24*a* of the annular step part 24 under its compressed state, the seat face 24*b* of the annular step part 24 cannot be used as a fixing face. For this reason, it is necessary to obtain a necessary glass holding force by increasing a height of the annular periphery face 24*a* and, therefore, it is obliged to thicken the edge member 21 in comparison with the present embodiment.

Figure 5:
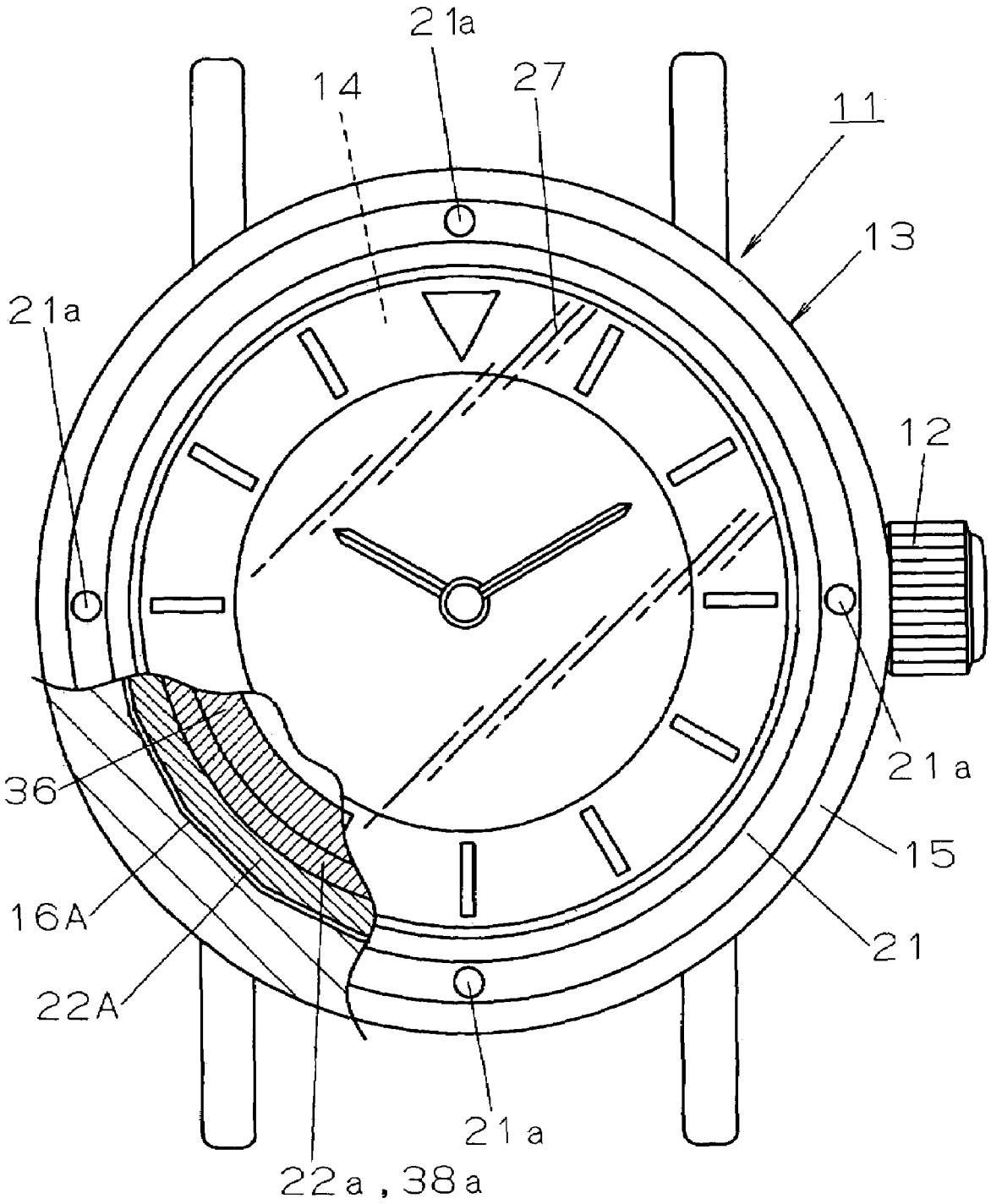
FIG. 5 is a plan view showing a wristwatch according to a second embodiment of the present invention, with its one part being cut off.

A second embodiment of the present invention is explained by referring to FIG. 5. Since the second embodiment is the same as the first embodiment except matters explained below, the same reference numeral is applied to the same constitution as the first embodiment and its explanation is omitted.

In the second embodiment, the edge member 21 functions also as an ornament ring. For this reason, e.g., in a surface of the edge member 21, there are provided, e.g., marks 21*a* in a 90-degree interval as ornament elements, and these marks 21*a* correspond respectively to 12 o'clock through 6 o'clock and 9 o'clock through 3 o'clock on the dial 14. Further, the wristwatch 11 of the second embodiment has a whirl-stop means of its edge member 21. The whirl-stop means is formed by a polygonal fitting hole 16A and a tubular part 22A whose outer periphery is polygonal shape. A corner number of the tubular part 22A and that of this fitting hole 16A are the same.

This whirl-stop means whirl-stops the edge member 21 by the catching in the peripheral direction by butting (engaging) between the corner of the polygonal fitting hole 16A and the corner of the polygonal tubular part 22A. For this reason, when meshing and screwing the attaching member 36 to the tubular part 22 of the edge member 21, by a rotation-stop means the fact can be prevented that the edge member 21 is forcedly rotated by the attaching member 36 which is rotation-operated.

Accordingly, at an assembly time, the screwing of the attaching member 36 can be easily performed without requiring a labor for manually stopping the rotation of the edge member 21, and the edge member 21 can be certainly fixed to the case band 15. By the similar reason, a separation of the attaching member 36 in disassembly work can be easily performed.

Moreover, as already mentioned, since there is no fact that the edge member 21 is forcedly rotated following upon the rotation operation of the attaching member 36, the mark 21*a* that is the ornament element of the edge member 21 can be held in a position which has suitably corresponded in relation to the dial 14. Incidentally, it is the same as the first embodiment except the matters explained above.

According to the present invention, it is possible to provide a timepiece in which it has been made possible to exchange the edge member without also exchanging the case band in a case where the edge member, to which the glass has been fixed, has been impaired, or the like.

What is claimed is:

1. A timepiece comprising:

an annular case band having a front side end part that forms a fitting hole and that has an edge receiving face around the fitting hole and having an engaging back face that extends continuously around the fitting hole;

a case back detachably attached to a back side end part of the case band;

an annular edge member having a tubular part that has a female thread and that is inserted into and disengageable from the fitting hole and a cover part overlapped with the edge receiving face;

a glass fitted and fixed to an annular step part formed in the edge member; and an attaching member which detachably attaches the tubular part to the front side end part, the attaching member having a male thread threadedly engaged with the female thread and a ring base part which engages with the engaging back face to thereby nip the front side end part of the case band between the ring base part and the cover part.

2. A timepiece according to claim 1; further including an annular seal packing nipped between the edge receiving face and the cover part under a compressed state.

3. A timepiece according to claim 1; further including rotation-stop means for stopping rotation of the edge member by engaging the fitting hole and the tubular part in their peripheral direction.

4. A timepiece according to claim 1; wherein the glass is fixed to the annular step part by an adhesive.

5. A timepiece comprising: an annular case band having a front side end part that protrudes radially inwardly toward the inside of the case band and defines a front opening of the case band, and a back side end part; a case back detachably attached to the back side end part of the case band; an annular edge member seated on a front surface of the front side end part and having a threaded tubular part removably inserted into the front opening of the case band; a glass fixed to the edge member; and an annular attaching member having a threaded part threadedly engaged with the threaded tubular part of the edge member, and a ring part that abuts a back surface of the front side end part so that the front side end part of the case band is held between the edge member and the attaching member.

6. A timepiece according to claim 5; further including an annular seal packing compressed between the edge member and the front surface of the front side end part of the case band.

7. A timepiece according to claim 5; wherein the edge member and the ring part of the attaching member overlap one another on the front and back surfaces, respectively, of the front side end part of the case band.

8. A timepiece according to claim 5; wherein the attaching member has operating parts configured to engage with a tool inserted into the case band from the back side thereof after detachment of the case back so that the tool can be used to unthread the attaching member from the edge member.

9. A timepiece according to claim 8; wherein the operating parts are disposed on a back side of the ring part of the attaching member.

10. A timepiece according to claim 5; wherein the edge member has ornamentation on a front surface thereof.

11. A timepiece according to claim 5; wherein the edge member is non-rotatable relative to the case band.

12. A timepiece according to claim 11; wherein the front opening of the case band is defined by plural flat surfaces that engage with flat surfaces on the edge member to prevent rotation of the edge member relative to the case band.

13. A timepiece according to claim 5; wherein the threaded part of the edge member extends into the front opening of the case band to a depth that does not reach the back surface of the front end side part of the case band.

14. A timepiece according to claim 5; wherein the threaded tubular part of the edge member comprises a female threaded tubular part and the threaded part of the attaching member comprises a male threaded part.

* * * * *